US007475457B1

(12) United States Patent
Gersten

(10) Patent No.: US 7,475,457 B1
(45) Date of Patent: Jan. 13, 2009

(54) MULTI-ENTITY URN

(76) Inventor: Dan Gersten, 29636 Quail Run Dr., Agoura Hills, CA (US) 91301

( * ) Notice: Subject to any disclaimer, the term of this patent is extended or adjusted under 35 U.S.C. 154(b) by 0 days.

(21) Appl. No.: 12/069,303

(22) Filed: Feb. 7, 2008

(51) Int. Cl.
*A61G 17/00* (2006.01)

(52) U.S. Cl. ..... 27/1

(58) Field of Classification Search ..... 27/1, 27/35; D99/5; 52/136; 220/23.87, 23.88, 220/528
See application file for complete search history.

(56) References Cited

U.S. PATENT DOCUMENTS 6,295,705 B1 10/2001 Gersten
6,421,890 B1 * 7/2002 Biggar ..... 27/1
6,735,831 B1 * 5/2004 Greiwe et al. ..... 27/1
6,944,921 B1 9/2005 Gersten
7,096,546 B2 * 8/2006 Poirier ..... 27/1
2004/0098846 A1 * 5/2004 Glass ..... 27/1

* cited by examiner

*Primary Examiner*—William L. Miller
(74) *Attorney, Agent, or Firm*—Sandy Lipkin

(57) ABSTRACT

A burial urn for cremated remains which utilizes a housing which covers an internal bin having at least one chamber which is adapted to connect with a plurality of chambers for the containment of remains and mementos therein. The exterior side edge of the housing is formed of a polygonal shape and is divided into a series of separate panels with there being a name plaque mounted on each panel. A single chamber is to align with a particular name plaque. The housing covers the internal bin with the internal bin being secure to the housing through a simple nut and bolt assembly.

5 Claims, 4 Drawing Sheets

MULTI-ENTITY URN

BACKGROUND OF THE INVENTION

1. Field of the Invention

The present invention relates generally to the field of receptacles, and more particularly to a burial urn which is adapted to contain the cremated remains of a plurality of family members or pets.

2. Description of the Prior Art

Cremation of the moral remains of living creatures, such as humans and pets, has become increasingly popular. The popularity of cremation is almost assuredly due to the fact that it is less expensive than being interred into the ground, and it may avoid storage charges if the remains are located within the individual's residence if not stored at some exterior location, such as in a mortuary. The end product of the cremation process, after removal of non-combustible materials and grinding, is a small volume of finely ground ash.

Disposal of this ash has taken many forms. One form would be to dispose of the ash into a sea, ocean, lake, or on land in a particular location. In such an instance, there is no need for a burial urn. However, some people choose to retain some or all of the cremated remains as constituting a memory of the loved one that has been lost. Typically, burial urns take the form of a vase or a similar type of container where the cremated remains of the lost loved one are to be placed. In some families where there have been a plurality of lost loved ones and this would means that there is a plurality of separate containers that are stored somewhere within the individual's residence, or if it is stored at an exterior location, within a crematorium or cemetery.

There is a need to design an attractive urn for a plurality of cremated remains that will function to store all or a portion of the cremated remains of a plurality of family members with this burial urn adapted to place within one's home or business.

The inventor of the instant invention has created a multi-use urn that is the subject of U.S. Pat. No. 6,944,921. This invention allowed for the placement of the remains of several loved ones in a single urn and a place for the placement of memorial plaques on the exterior to correspond to the space inside that contained the referenced remains. The instant invention seeks to improve on the previous urn by providing a container that has fewer parts, specifically no internal lids. Furthermore, the entire urn is composed of an internal bin with multiple compartments for the placement therein not only of remains, but mementos. A lid covers the entire internal bin and the lid and internal bin are attached through a simple nut and bolt assembly.

SUMMARY OF THE INVENTION

The primary objective of the present invention is to construct a burial urn which is designed to be utilized not only for a single individual but actually a plurality of individuals.

Another objective of the present invention is to construct a burial urn which is attractive in appearance and can be located within a person's residence.

Another objective of the present invention is to construct a burial urn for the cremated remains of loved ones of a single family which allows the living family members to have the deceased family members with the living family members throughout the years regardless of where the living family members move and reside.

Another objective of the present invention is to construct a burial urn that is designed to be both a receptacle for the combined cremated remains of loved ones as well as a log of who they were relative to the family, much like the family plot of yore.

Another objective of the present invention is to construct a burial urn which has inscribed thereon certain information of the deceased party, such as name, date of birth and date of death.

Another objective of the present invention is to simplify the number of parts and manner of construction of the prior art.

The preferred embodiment teaches a burial urn for a plurality of cremated remains comprising a housing having an internal chamber which is closed except for the bottom which is open, the housing having a polygonal exterior surface divided into a series of separate panels, each panel having a space for having mounted thereon a name plaque with there being a plurality of spaces for name plaques on the housing; an internal bin that fits inside of the housing, the internal bin being further divided into a plurality of chambers, each of the chambers to align with each of the plurality of spaces for said name plaques with there being an equal number of chambers to the number of the spaces for name plaques, each of the chambers having an internal compartment into which cremated remains and mementos can be stored; and a means for securing the internal bin to said housing, such as a nut and bolt assembly.

The above embodiment can be further modified by defining that each of the spaces for the name plaques are of substantially the same size.

A second embodiment of the instant invention defines a method for providing a mobile family plot storing the cremated remains of loved ones comprising: retrieving a quantity of cremated remains; placement of the cremated remains an a multi-use urn, the multi-use urn further comprising a housing having an internal chamber which is closed except for the bottom which is open, the housing having a polygonal exterior surface divided into a series of separate panels, each panel having a space for having mounted thereon a name plaque with there being a plurality of spaces for name plaques on the housing; an internal bin that fits inside of the housing, the internal bin being further divided into a plurality of chambers, each of the chambers to align with each of the plurality of spaces for the name plaques with there being an equal number of chambers to the number of spaces for name plaques, each of the chambers having an internal compartment into which cremated remains and mementos can be stored; and a means for securing the internal bin to the housing, such as a nut and bolt assembly.

The above embodiment can be further modified by defining that each of the spaces for the name plaques are of substantially the same size.

The above embodiment can be further modified by defining that there further comprises the step of placing inside of the multi-use chambers mementos of the loved one.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
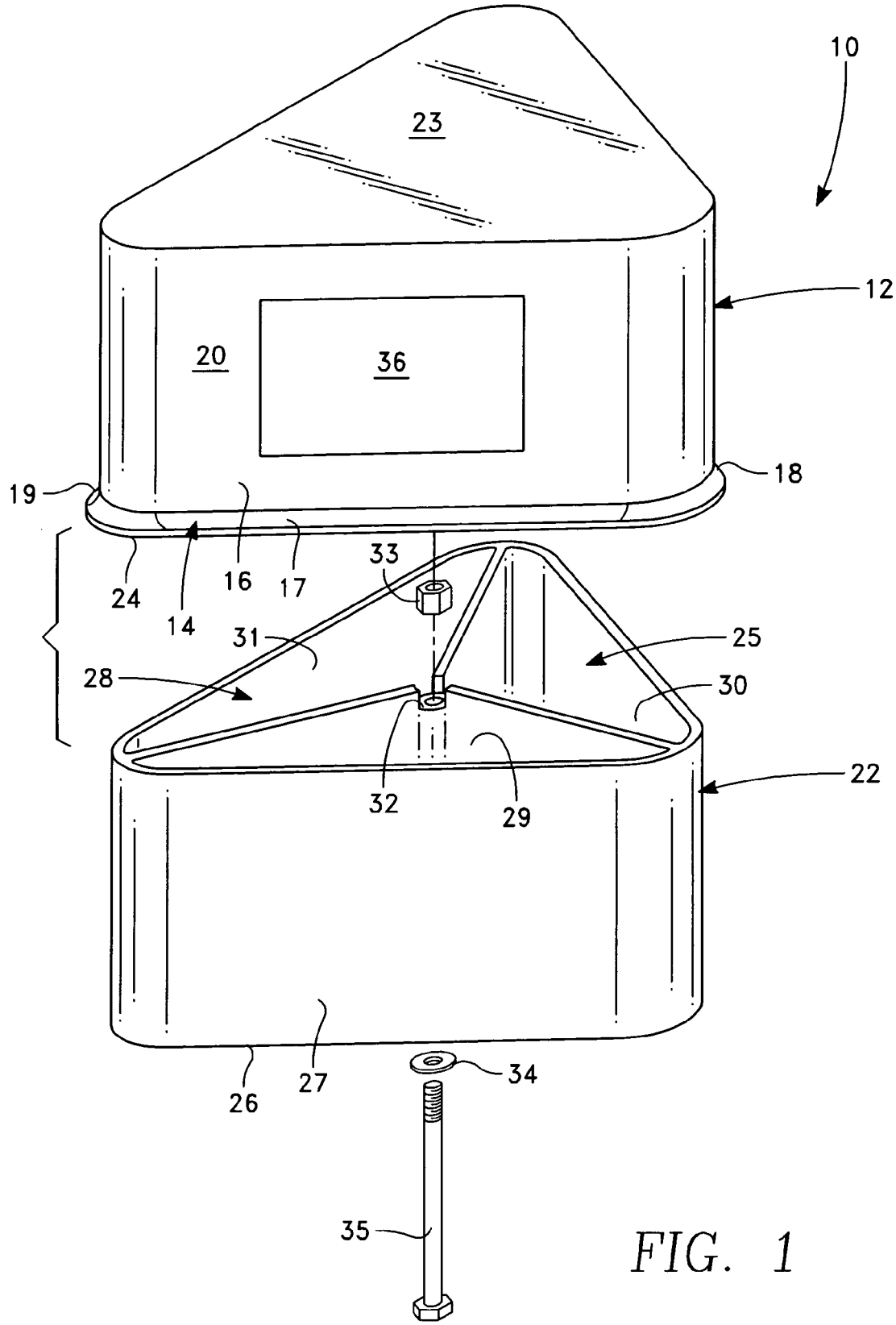
FIG. 1 is top exploded view of the instant invention.
Figure 2:
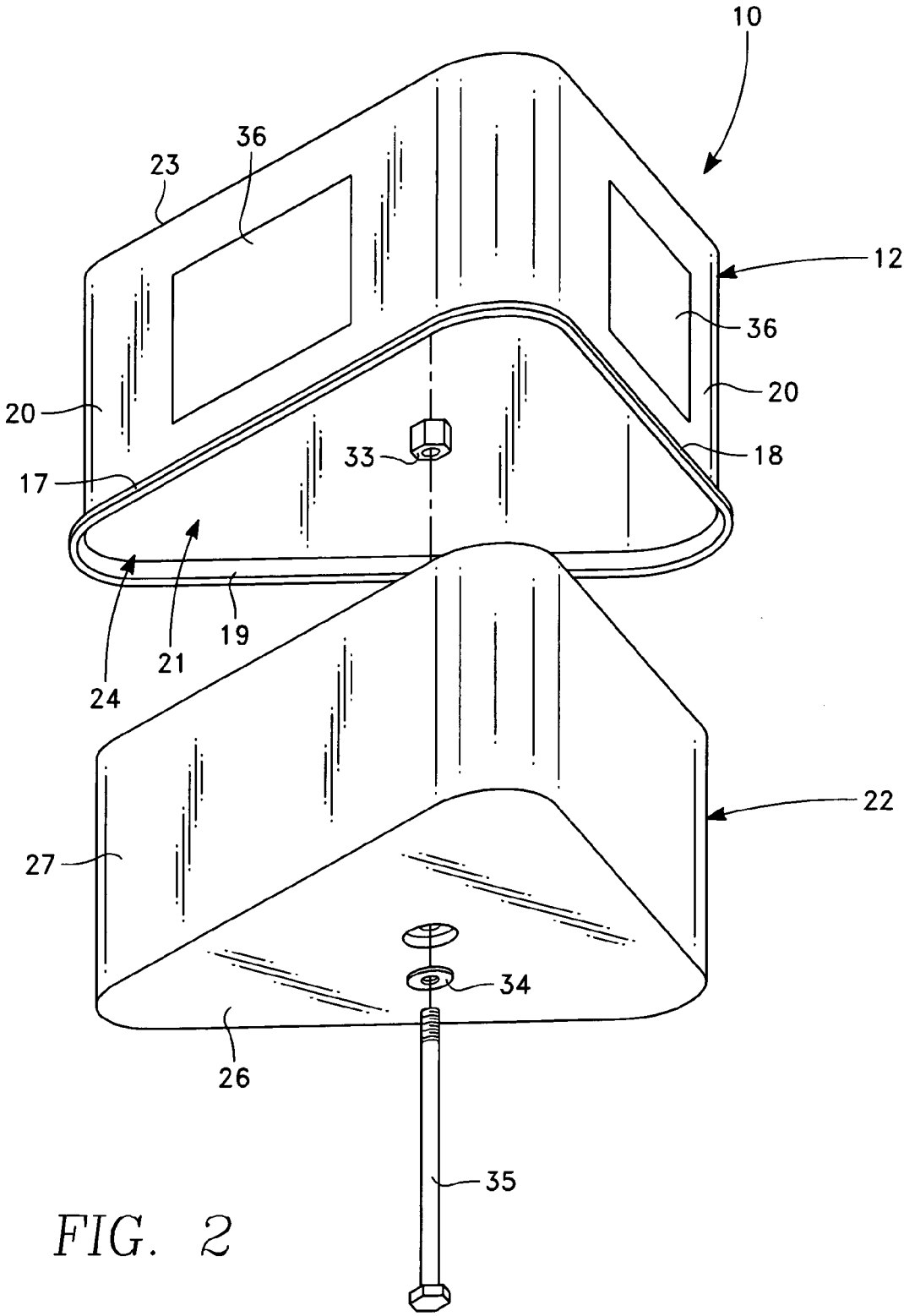
FIG. 2 is a bottom exploded view of the instant invention.
Figure 3:
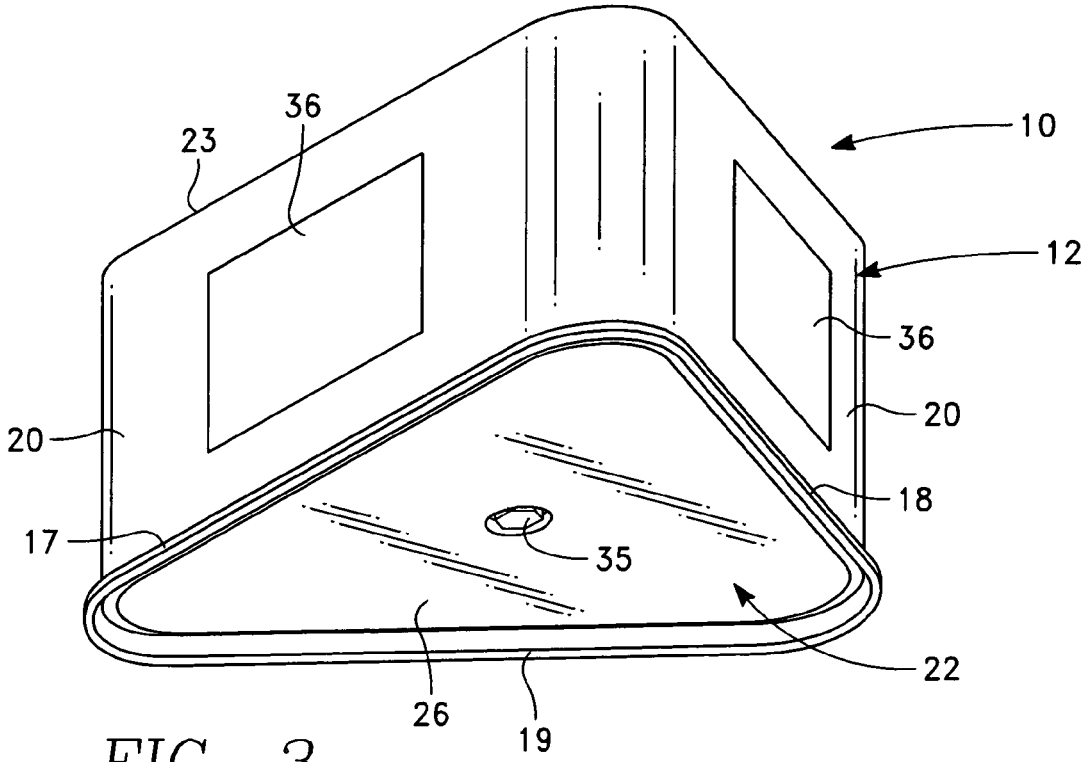
FIG. 3 is bottom perspective view of the instant invention.
Figure 4:
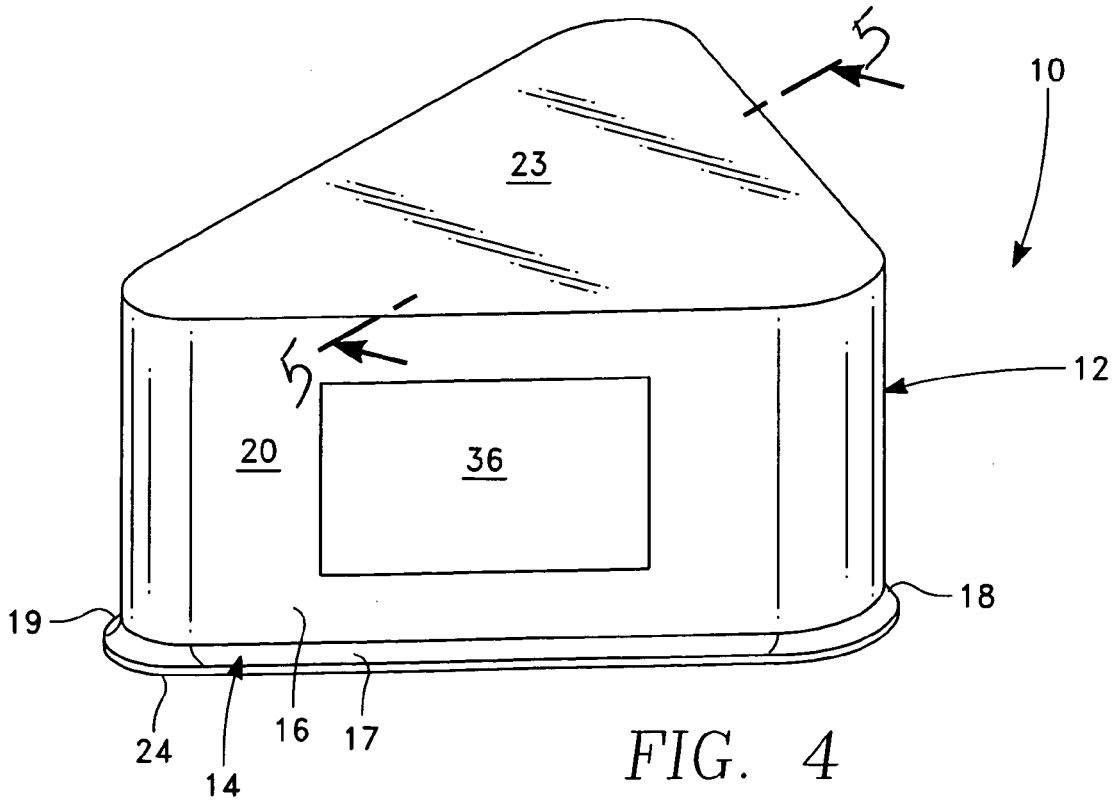
FIG. 4 is a top perspective view of the instant invention.

Referring particularly to the drawings, there is shown the burial urn 10 of this invention. The burial urn 10 comprises a housing cover 12, which is defined by a polygonal shape base 14 from which upwardly extends one sidewall face 16 for each of the polygonal base edges 17, 18, 19. This particular polygon is a triangle, having three edges and three sidewalls, but it is to be understood that the base can be of any polygonal shape. Each of the sidewall faces 16 forms a corresponding panel 20. The housing 12 has a closed top 23 and an open bottom 24.

The housing 12 has an internal chamber 21. The internal chamber 21 receives the internal bin 22. The internal bin 22 has an open top 25 and a closed bottom 26. The internal bin 22 has sidewalls 27 that correspond to the sidewalls 16 of the housing 12. The internal bin as an interior space 28 that is divided here into three subspaces 29, 30, 31. Each of these subspaces 29, 30, 31 has the capacity to receive a smaller container, such as a small plastic bag, of remains as well as any other mementoes of the deceased that living family members would like placed therein.

Once the interior subspaces 29, 30, 31 have been filled with the desired objects, the internal bin 22 fits inside of the housing cover 12 with the open top 25 sitting flush against the closed top 23 of the housing 12. Through the center of the internal bin is a sleeve 32 that receives a nut 33. The bolt 35 passes through the sleeve 32 and is fitted with a washer 34. A nut 33 secures the bolt 35 in place.

A name plaque 36 is designed to be adhesively secured to each respective panel 20. It is to be understood that there is a separate name plaque 36 for each panel 20. The name plaque 36 comprises a thin, flat, rectangular shaped piece which could be formed of metal, plastic, or wood. Inscribed on the exterior surface of the name plaque 24 is identifying indicia, such as a name of a person that has passed on, the date of birth of the person and the date of death plus other information if such is desired.

Figure 5:
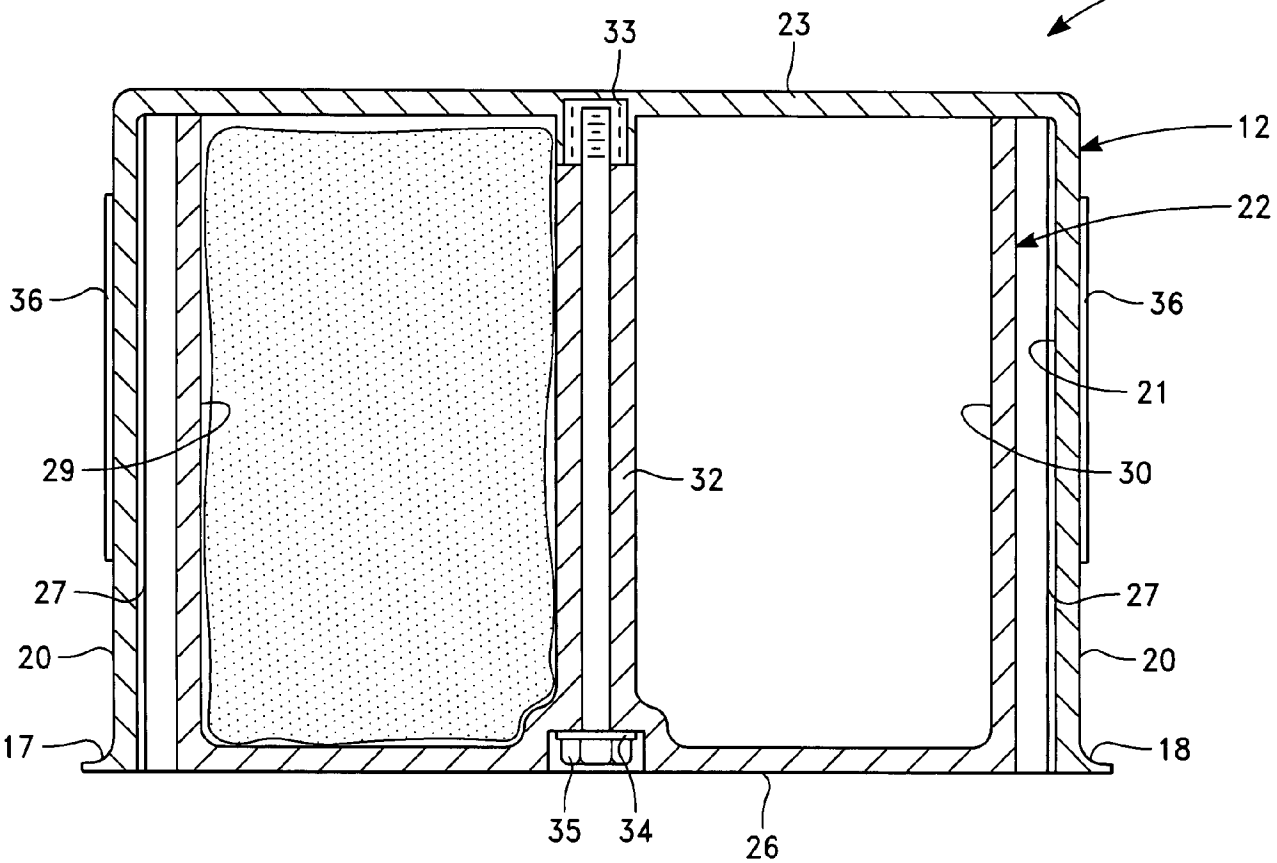
FIG. 5 is taken along line 5-5 in FIG. 4.

FIG. 5 shows the urn in cross-section. The material used to make the cover can be plastic, wood or laminate. The finish can provide any look the client wants, thereby reducing the costs of production as needed.

The subject matter of this invention is discussed in conjunction with humans but could also be used for pets.

The illustrations and examples provided herein are for explanatory purposes and are not intended to limit the scope of the appended claims. This disclosure is to be considered an exemplification of the principles of the invention and is not intended to limit the spirit and scope of the invention and/or claims of the embodiment illustrated. Those skilled in the art will make modifications to the invention for particular applications of the invention.

What is claimed is:

1. A burial urn for a plurality of cremated remains comprising a housing having an internal chamber which is closed except for the bottom which is open, said housing having a polygonal exterior surface divided into a series of separate panels, each said panel defining a space for having mounted thereon a name plaque;

an internal bin that fits inside of said housing, said internal bin being divided into a plurality of chambers, each of said chambers to align with each of said plurality of spaces for said name plaques with there being an equal number of chambers and said spaces for said name plaques, each of said chambers having an internal compartment into which said cremated remains and mementos are to be stored; and the center of the bin includes a sleeve which cooperates with a nut and bolt assembly for securing said internal bin to said housing.

2. The burial urn as defined in claim 1 wherein each of said spaces for said name plaques are of substantially the same size.

3. A method of providing a mobile family plot storing cremated remains of loved ones comprising:

retrieving a quantity of said cremated remains;

placement of said cremated remains in a multi-use urn, said multi-use urn comprising a housing having an internal chamber which is closed except for the bottom which is open, said housing having a polygonal exterior surface divided into a series of separate panels, each said panel defining a space for having mounted thereon a name plaque;

an internal bin that fits inside of said housing, said internal bin being divided into a plurality of chambers, each of said chambers to align with each of said plurality of spaces for said name plaques with there being an equal number of chambers and said spaces for said name plaques, each of said chambers having an internal compartment into which said cremated remains and mementos are to be stored; and the center of the bin includes a sleeve which cooperates with a nut and bolt assembly for securing said internal bin to said housing.

4. The method as defined in claim 3 wherein each of said spaces for said name plaques are of substantially the same size.

5. The method as defined in claim 3 wherein there further comprises the step of placing inside of said chambers mementos of said loved one.

* * * * *